US007148765B2

(12) United States Patent
Tahara et al.

(10) Patent No.: US 7,148,765 B2
(45) Date of Patent: Dec. 12, 2006

(54) WAVEGUIDE/MICROSTRIP LINE CONVERTER WITH MULTI-LAYER WAVEGUIDE SHORTING PORTION

(75) Inventors: Yukihiro Tahara, Tokyo (JP); Moriyasu Miyazaki, Tokyo (JP); Kouichi Matsuo, Tokyo (JP); Kazuyoshi Inami, Tokyo (JP); Makoto Matsunaga, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 8 days.

(21) Appl. No.: 10/477,404

(22) PCT Filed: Mar. 12, 2003

(86) PCT No.: PCT/JP03/02927

§ 371 (c)(1),
(2), (4) Date: Nov. 12, 2003

(87) PCT Pub. No.: WO03/077353

PCT Pub. Date: Sep. 18, 2003

(65) Prior Publication Data

US 2004/0119554 A1 Jun. 24, 2004

(30) Foreign Application Priority Data

Mar. 13, 2002 (JP) ..... 2002-068754

(51) Int. Cl.
*H01P 5/107* (2006.01)

(52) U.S. Cl. ..... 333/26; 333/34

(58) Field of Classification Search ..... 333/26, 333/34, 33

See application file for complete search history.

(56) References Cited

U.S. PATENT DOCUMENTS 6,060,959 A * 5/2000 Yakuwa ..... 333/26
6,087,907 A 7/2000 Jain
2002/0097108 A1 7/2002 Jain

FOREIGN PATENT DOCUMENTS

EP 0 920 071 A2 6/1999

(Continued)

OTHER PUBLICATIONS

Gresham I. et al.; "A Compact Manufacturable 76-77-GHz Radar Module for Commerical ACC Applications;" IEEE Transactions on Microwave Theory and Techniques, vol. 49, No. 1, Jan. 2001; pp. 44-58.

(Continued)

*Primary Examiner*—Benny Lee
(74) *Attorney, Agent, or Firm*—Birch, Stewart, Kolasch & Birch, LLP

(57) ABSTRACT

The invention provides a dielectric substrate; a ground conductor pattern is formed on one surface of the dielectric substrate and which has a ground conductor pattern omission portion; a strip conductor pattern formed on a surface of the dielectric substrate opposite to the surface having the ground conductor pattern; a conductor pattern for shorting of a waveguide formed so as to be continuously connected to the strip conductor pattern; connecting conductors for connecting the ground conductor pattern and the conductor pattern to each other within the dielectric substrate; and a waveguide connected to the dielectric substrate so as to correspond to the ground conductor pattern omission portion. Also, a microstrip line is constituted by the strip conductor pattern, the ground conductor pattern, and the dielectric substrate. Further, a dielectric waveguide shorting portion is constituted by the conductor pattern, the ground conductor pattern, and the connecting conductors.

8 Claims, 8 Drawing Sheets

FOREIGN PATENT DOCUMENTS

| | | | |
|---|---|---|---|
| JP | 9-214212 | A | 8/1997 |
| JP | 10-107518 | A | 4/1998 |
| JP | 11-46114 | A | 2/1999 |
| JP | 2000-244212 | A | 9/2000 |
| JP | 2002-208806 | A | 7/2002 |

OTHER PUBLICATIONS

Hoover et al., IEEE Transactions on Microwave Theory and Techniques, pp. 274 (1967).

* cited by examiner

WAVEGUIDE/MICROSTRIP LINE CONVERTER WITH MULTI-LAYER WAVEGUIDE SHORTING PORTION

BACKGROUND OF THE INVENTION

1. Field of the Invention

The present invention relates to a waveguide-to-microstrip transition mainly used in a microwave band and a millimeter-wave band.

2. Description of the Background Art

In a conventional waveguide-to-microstrip transition, a dielectric substrate is fixed so as to be held between a waveguide and a shorting waveguide block. A strip conductor pattern is provided on one surface of the dielectric substrate, and a ground conductor pattern connected to an opening portion of the waveguide is provided on the other surface of the dielectric substrate. The strip conductor pattern, the ground conductor pattern, and the dielectric substrate constitute a microstrip line. If a distance between a shorting surface of the shorting waveguide block and the strip conductor pattern is set to about ¼ of a guide wavelength of the waveguide, then a magnitude of a magnetic field within the waveguide becomes maximum in a position where the strip conductor pattern is inserted. Hence, a propagation mode of the microstrip line and a propagation mode of the waveguide are well coupled to each other. Accordingly, a high frequency signal which has been propagated through the waveguide can be propagated through the microstrip line without generating a large reflection (for example, refer to JP 2000-244212 A).

In such a conventional waveguide-to-microstrip transition as described above, about ¼ of the guide wavelength of the waveguide is required for a length from the strip conductor pattern to the shorting surface of the shorting waveguide block. Hence, the shorting waveguide block is projected from the dielectric substrate. Accordingly, there is a problem in that a transition is difficult to be miniaturized especially in a microwave band.

On the other hand, if a position shift occurs among the waveguide, then the shorting waveguide block, and the strip conductor pattern, characteristics of the transition are degraded. Thus, it is necessary to assemble the components or parts with high accuracy. However, there is a problem in that since the components or parts need to be made very small in the millimeter-wave band, the components or parts are difficult to be assembled with high accuracy, and hence mass production of the transition is difficult to be realized.

In addition, in the case where the conventional waveguide-to-microstrip transition is provided in an input/output portion of a package having high frequency elements mounted thereto, a space is made in a connection portion between the waveguide and the microstrip line. Thus, there is also a problem in that the inside of the package cannot be hermetically sealed.

The present invention has been made in order to solve the above-mentioned problems, and it is therefore an object of the present invention to obtain a miniature waveguide-to-microstrip transition which is easy in mass production in a microwave band and a millimeter-wave band.

Moreover, it is another object of the present invention to obtain a waveguide-to-microstrip transition in which when the waveguide-to-microstrip transition is applied to a high frequency package having a waveguide connected at an input/output portion, the inside of the package can be hermetically sealed.

SUMMARY OF THE INVENTION

A waveguide-to-microstrip transition according to the present invention includes: a dielectric substrate; a ground conductor pattern which is formed on one surface of the dielectric substrate and which has a ground conductor pattern omission portion; a strip conductor pattern formed on a surface of the dielectric substrate opposite to the surface having the ground conductor pattern; a conductor pattern for shorting of a waveguide formed so as to be continuously connected to the strip conductor pattern; connecting conductors for connecting the ground conductor pattern and the conductor pattern for shorting of a waveguide to each other within the dielectric substrate; and a waveguide connected to the dielectric substrate so as to correspond to the ground conductor pattern omission portion.

Also, a microstrip line is constituted by the strip conductor pattern, the ground conductor pattern, and the dielectric substrate.

Further, a dielectric waveguide shorting portion is constituted by the conductor pattern for shorting of a waveguide, the ground conductor pattern, and the connecting conductors.

DETAILED DESCRIPTION OF THE PREFERRED EMBODIMENTS

Figure 1:
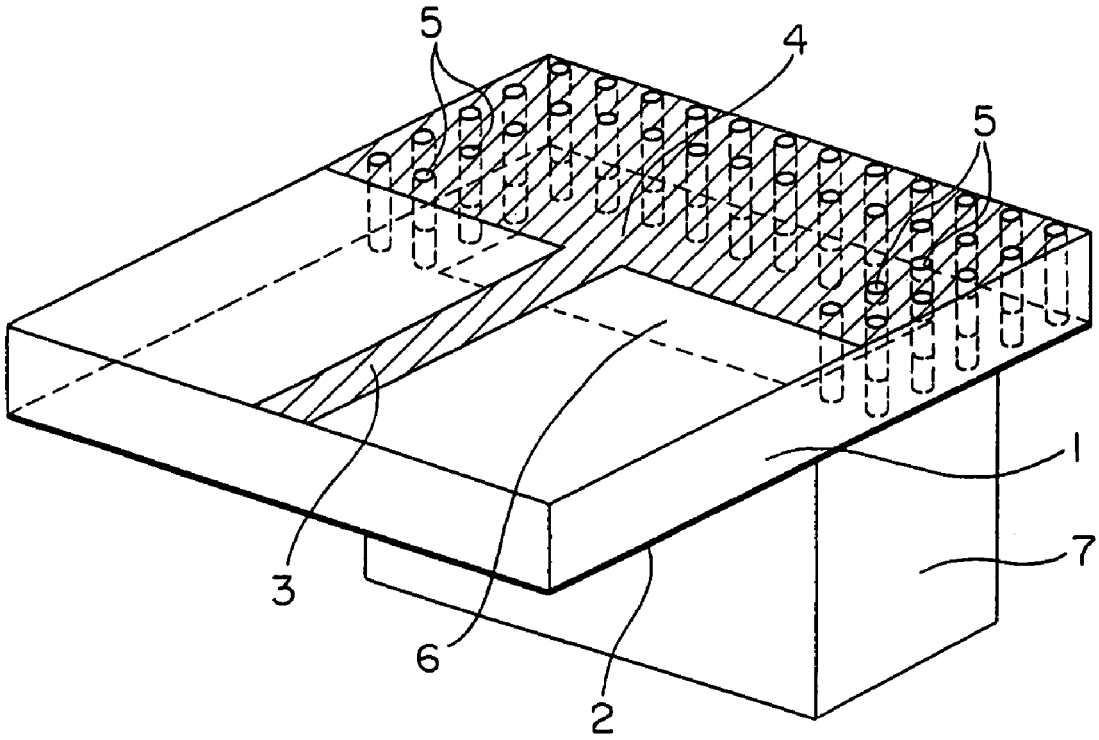
FIG. 1 is a perspective view showing a construction of a waveguide-to-microstrip transition according to Embodiment 1 of the present invention.

Embodiments of the present invention will hereinafter be described on the basis of the drawings, wherein same reference numerals refer to the same or corresponding features.

Embodiment 1

A waveguide-to-microstrip transition according to Embodiment 1 of the present invention will now be described with reference to the drawings. FIG. 1 is a perspective view showing a construction of a waveguide-to-microstrip transition according to Embodiment 1 of the present invention.

Figure 2:
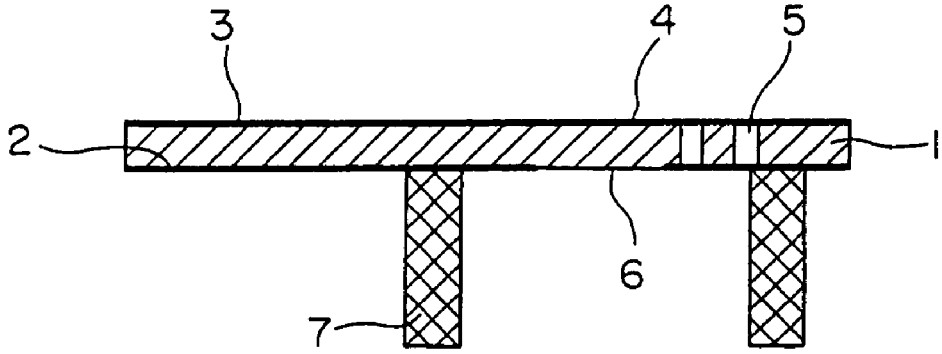
FIG. 2 is a cross sectional view showing a construction of the waveguide-to-microstrip transition according to Embodiment 1 of the present invention.
Figure 3:
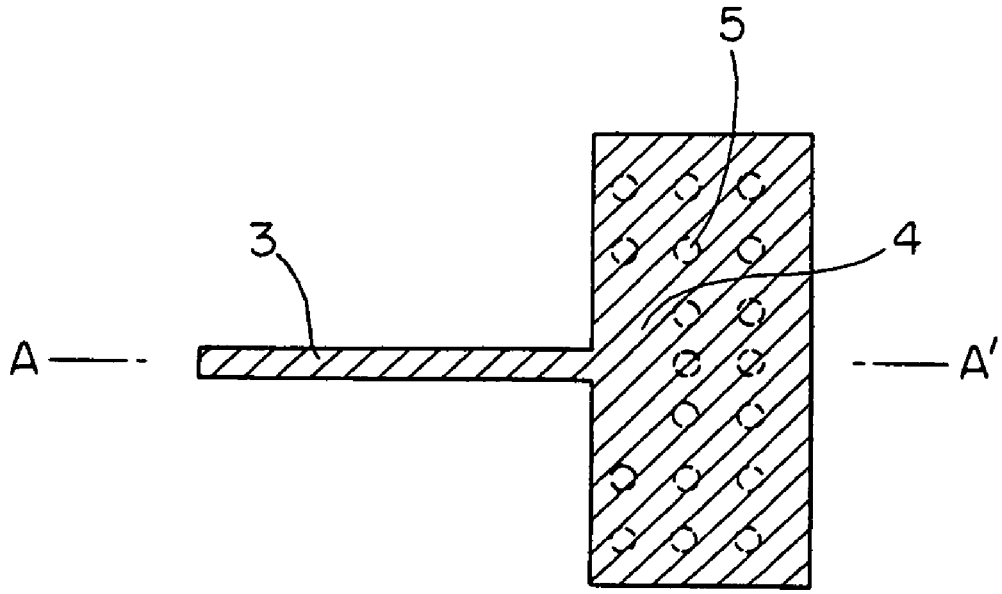
FIG. 3 is a view showing a conductor pattern arranged on an upper side surface of a dielectric substrate shown in FIG. 1.
Figure 4:
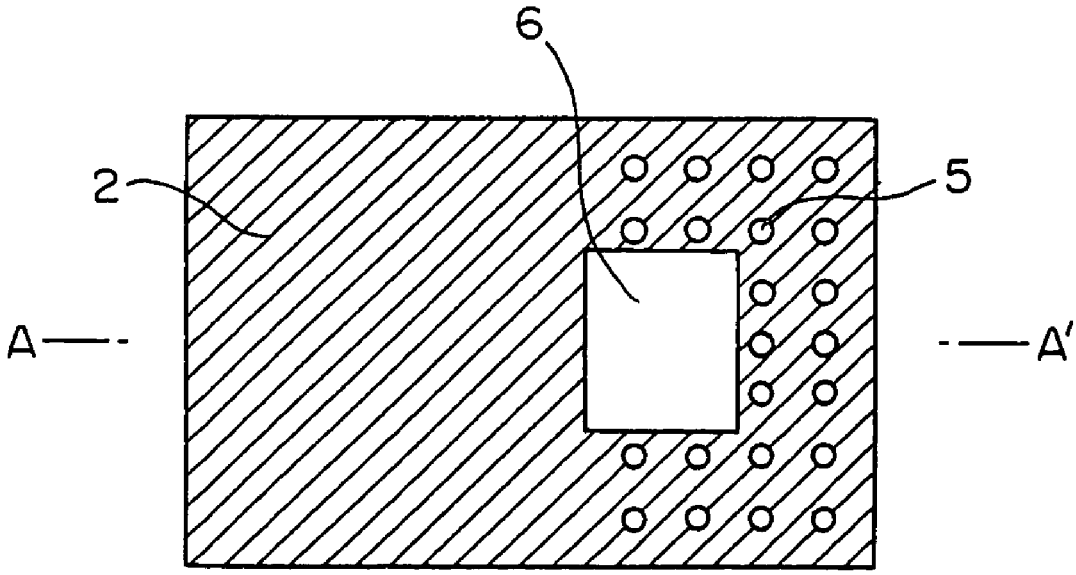
FIG. 4 is a view showing a conductor pattern arranged on a lower side surface of the dielectric substrate shown in FIG. 1.

FIG. 2 is a cross sectional view showing the waveguide-to-microstrip transition shown in FIG. 1. Also, FIG. 3 is a view showing a conductor pattern arranged on an upper side surface of a dielectric substrate shown in FIG. 1. Moreover, FIG. 4 is a view showing a conductor pattern arranged on a lower side surface of the dielectric substrate shown in FIG. 1. Note that the cross sectional view shown in FIG. 2 is given in the form of a cross sectional view taken along a line A–A' of FIGS. 3 and 4. In addition, in those figures, the same reference numerals designate the same or corresponding portions.

In FIGS. 1 to 4, a ground conductor pattern 2 is arranged on a lower side surface of a dielectric substrate 1. A strip conductor pattern 3 and a conductor pattern 4 for shorting of a waveguide are arranged on an upper side surface of the dielectric substrate 1. Vias 5 for a waveguide wall (conductors for connection) are provided across the ground conductor pattern 2 and the conductor pattern 4 for shorting of a waveguide. In addition, a ground conductor pattern omission portion 6 is provided in the ground conductor pattern 2. A waveguide 7 is provided on a lower side of the ground conductor pattern 2. Note that the via is used as a term meaning a columnar conductor in this specification.

In addition, in those figures, the ground conductor pattern 2, the strip conductor pattern 3, and the dielectric substrate 1 constitute "a microstrip line". The vias 5 for a waveguide wall are provided in the periphery of the ground conductor pattern omission portion 6 in order to connect the ground conductor pattern 2 and the conductor pattern 4 for shorting of a waveguide to each other. The ground conductor pattern 2, the conductor pattern 4 for shorting of a waveguide, and the vias 5 for a waveguide wall constitute a "dielectric waveguide shorting portion". The waveguide 7 is connected so as to correspond to the ground conductor pattern omission portion 6 provided on the lower side of the dielectric substrate 1.

Next, an operation of the waveguide-to-microstrip transition according to Embodiment 1 will hereinbelow be described with reference to the drawings.

In the microstrip line, an electric field is generated between the ground conductor pattern 2 and the strip conductor pattern 3. On the other hand, in the waveguide 7, a central portion of the waveguide cross section has a distribution of the strongest electric field. Then, if the strip conductor pattern 3 constituting the microstrip line is connected to a center of the dielectric waveguide shorting portion of the conductor pattern 4 for shorting of a waveguide constituting the dielectric waveguide shorting portion, then a portion having the generated electric field in the microstrip line agrees with a portion having a strong electric field in the waveguide 7. Since the electric field distribution of the microstrip line is near that of the waveguide 7, a high frequency signal can be propagated without generating a large reflection.

As described above, according to Embodiment 1, the shorting waveguide block projecting from the dielectric substrate by about ¼ of the guide wavelength as in the above-mentioned prior art example is removed and the highly accurate assembly is not required. Hence, there is offered an effect that the miniature waveguide-to-microstrip transition is realized which is easy in mass production.

In addition, the waveguide-to-microstrip transition is constituted by only the conductor patterns and the vias of the substrate. Thus, there is also offered an effect that the waveguide-to-microstrip transition can be formed inside the dielectric substrate, and can also be incorporated easily in a package formed using ceramics and the like.

Embodiment 2

Next, a waveguide-to-microstrip transition according to Embodiment 2 of the present invention will hereinbelow be described with reference to the drawings.

Figure 5:
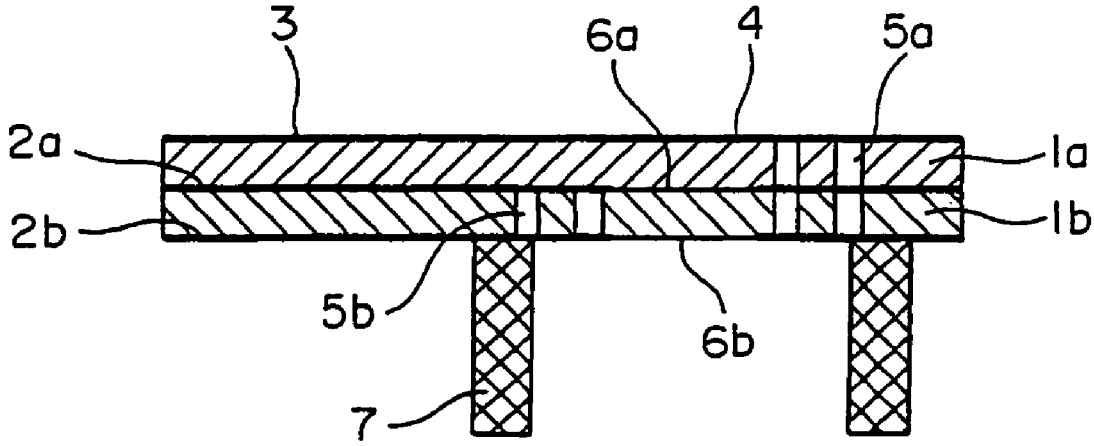
FIG. 5 is a cross sectional view showing a construction of a waveguide-to-microstrip transition according to Embodiment 2 of the present invention.
Figure 6:
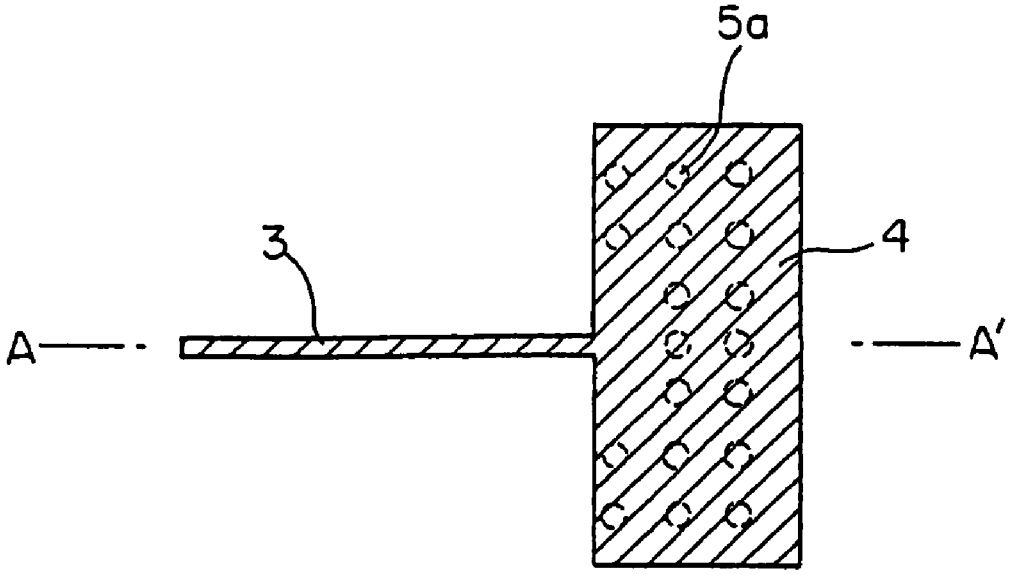
FIG. 6 is a view showing a conductor pattern arranged on an upper side surface of an upper dielectric substrate shown in FIG. 5.
Figure 7:
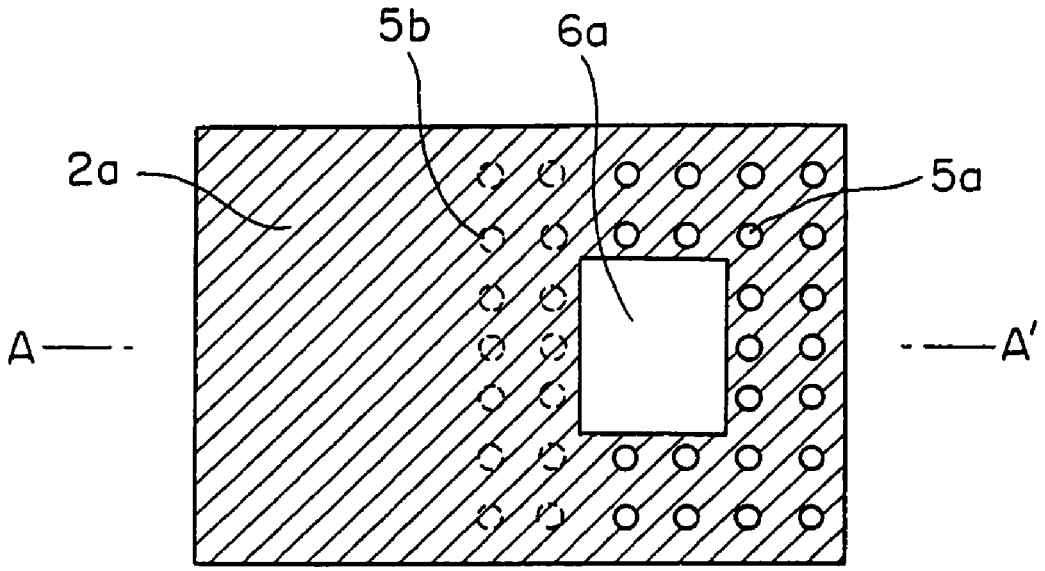
FIG. 7 is a view showing a conductor pattern arranged on a lower side surface of the upper dielectric substrate shown in FIG. 5.
Figure 8:
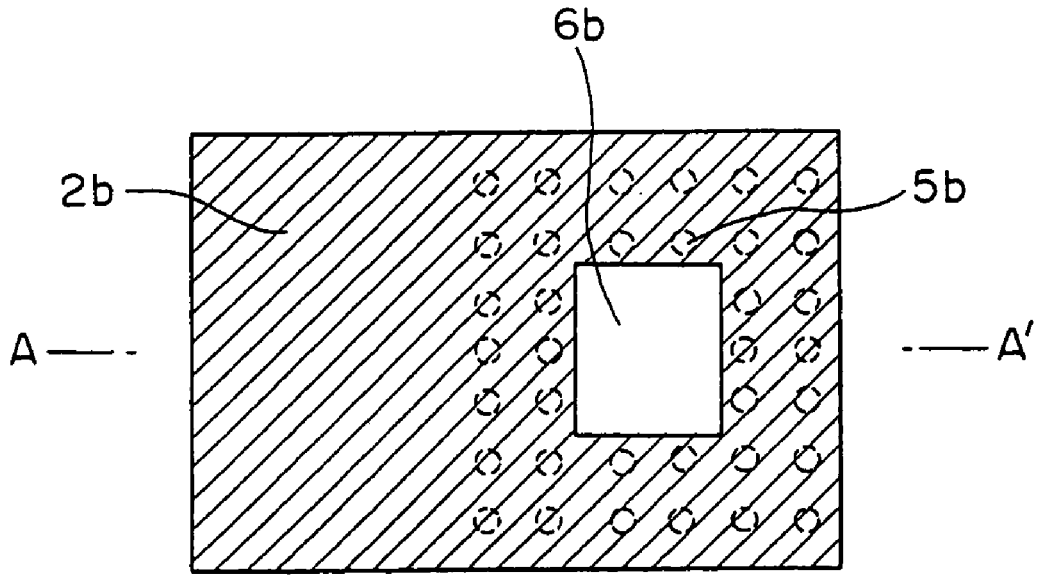
FIG. 8 is a view showing a conductor pattern arranged on a lower side surface of a lower dielectric substrate shown in FIG. 5.

FIG. 5 is a cross sectional view showing a construction of the waveguide-to-microstrip transition according to Embodiment 2 of the present invention. Also, FIG. 6 is a view showing a conductor pattern arranged on an upper side surface of an upper dielectric substrate shown in FIG. 5. FIG. 7 is a view showing a conductor pattern arranged on a lower side surface of the upper dielectric substrate shown in FIG. 5. Moreover, FIG. 8 is a view showing a conductor pattern arranged on a lower side surface of a lower dielectric substrate shown in FIG. 5. Note that, the cross sectional view shown in FIG. 5 is given in the form of a cross sectional view taken along a line A–A' of FIGS. 6 to 8.

In FIGS. 5 to 8, a ground conductor pattern 2*a* is arranged on a lower side surface of a dielectric substrate 1*a*. A ground conductor pattern 2*b* is arranged on a lower side surface of a dielectric substrate 1*b*. A strip conductor pattern 3 and a conductor pattern 4 for shorting of a waveguide are arranged on an upper side surface of the dielectric substrate 1*a*. Vias 5*a* for a waveguide wall are provided across the ground conductor pattern 2*a* and the conductor pattern 4 for shorting of a waveguide. Vias 5*b* for a waveguide wall are provided across the ground conductor pattern 2*b* and the ground conductor pattern 2*a*. In addition, a ground conductor pattern omission portion 6*a* is provided in the ground conductor pattern 2*a*, as shown in FIG. 7. A ground conductor pattern omission portion 6*b* is provided in the ground conductor pattern 2*b*, as shown in FIG. 8. A waveguide 7 is provided on a lower side of the ground conductor pattern 2*b*, as shown in FIG. 5.

The strip conductor pattern 3 is provided on the upper side surface of the dielectric substrate 1*a*, and the ground conductor pattern 2*a* is provided in the lower side surface of the dielectric substrate 1*a* to thereby construct a "microstrip line". In addition, the conductor pattern 4 for shorting of a waveguide is provided in the upper side surface of the dielectric substrate 1*a*, the ground conductor pattern 2*a* is provided on the lower side surface of the dielectric substrate 1*a*, and the vias 5*a* for a waveguide wall for connecting the conductor pattern 4 for shorting of a waveguide and the ground conductor pattern 2*a* to each other are provided to thereby construct a "waveguide shorting portion". Moreover, the ground conductor pattern 2*b* is provided on the lower side surface of the dielectric substrate 1*b*, and the vias 5*b* for a waveguide wall for connecting the ground conductor patterns 2*a* and 2*b* to each other are provided to thereby construct a "dielectric waveguide". The waveguide 7 is provided under the dielectric substrate 1*b* so as to correspond to an opening of the dielectric waveguide.

Next, an operation of the waveguide-to-microstrip transition according to Embodiment 2 will herein below be described with reference to the drawings.

In the waveguide-to-microstrip transition having the construction as described above, a high frequency signal inputted to the microstrip line provided on the dielectric substrate 1*a* is propagated through the dielectric waveguide formed using the dielectric substrate 1*b* via the waveguide shorting portion. Moreover, the high frequency signal passes through the ground conductor pattern omission portion 6*b* to be propagated through the waveguide 7.

As described above, according to Embodiment 2, similarly to the above-mentioned embodiment 1, the shorting waveguide block projecting from the dielectric substrate by about ¼ of the guide wavelength as in the above-mentioned prior art example is removed and the highly accurate assembly is not required. Hence, it is possible to realize the miniature waveguide-to-microstrip transition which is easy in mass production.

In addition, the waveguide-to-microstrip transition is constituted by only the conductor patterns and the vias of the substrate. Thus, there is offered an effect that the waveguide-to-microstrip transition can be formed inside the dielectric substrate, and can also be incorporated easily in a package formed using ceramics and the like.

Moreover, an impedance of the dielectric waveguide which is constituted by the ground conductor pattern, and the vias for a waveguide wall within the dielectric substrate is adjusted, whereby it is possible to realize the waveguide-to-microstrip transition which has the excellent characteristics and with which impedance matching with a waveguide connected to the outside is easy to be obtained.

Embodiment 3

Next, a waveguide-to-microstrip transition according to Embodiment 3 of the present invention will hereinbelow be described with reference to the drawings.

Figure 9:
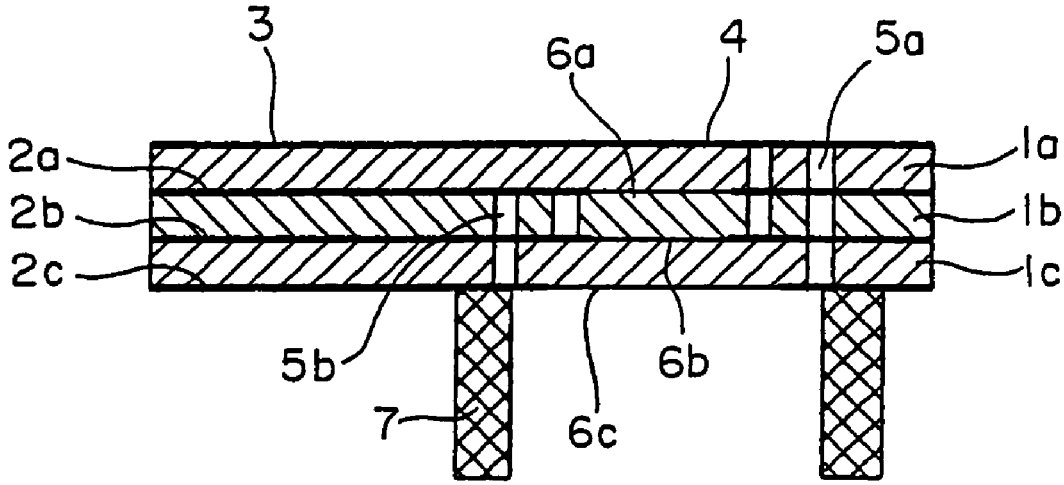
FIG. 9 is a cross sectional view showing a construction of a waveguide-to-microstrip transition according to Embodiment 3 of the present invention.
Figure 10:
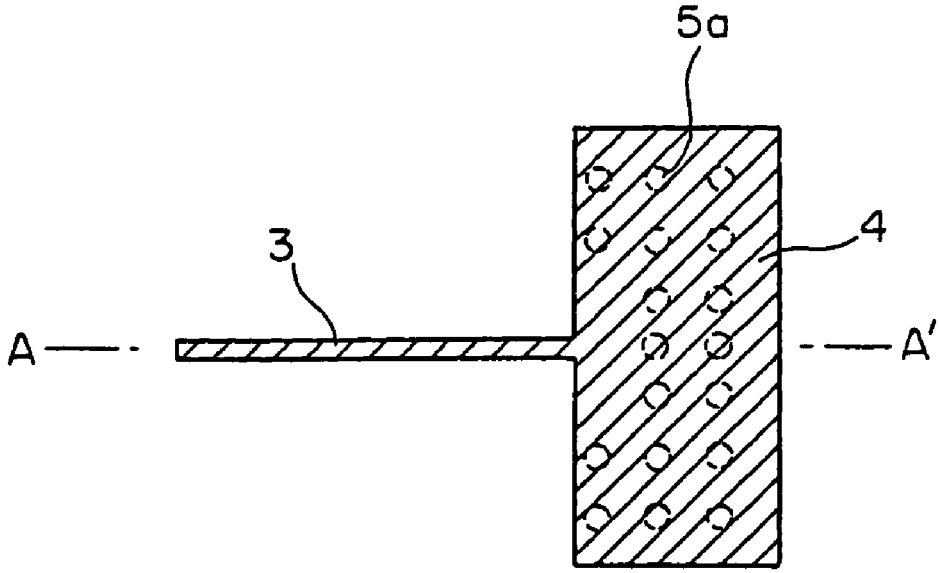
FIG. 10 is a view showing a conductor pattern arranged on an upper side surface of an upper dielectric substrate shown in FIG. 9.
Figure 11:
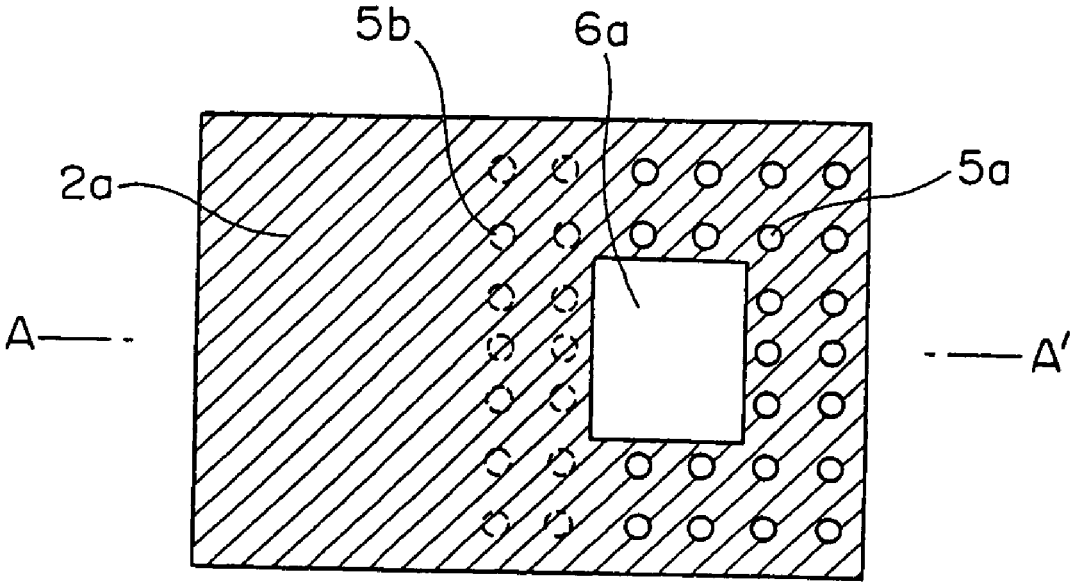
FIG. 11 is a view showing a conductor pattern arranged on a lower side surface of the upper dielectric substrate shown in FIG. 9.
Figure 12:
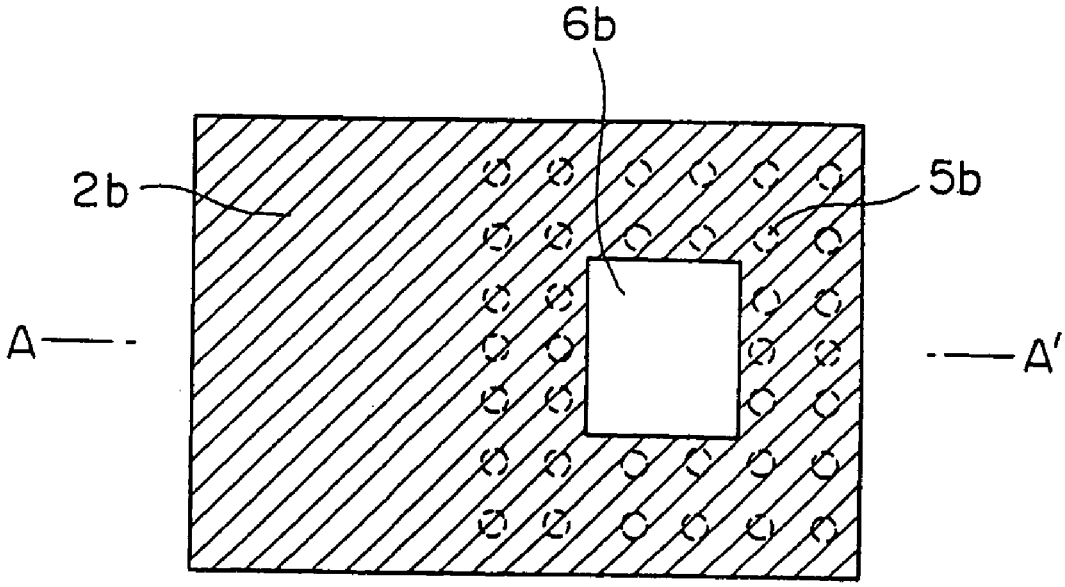
FIG. 12 is a view showing a conductor pattern arranged on a lower side surface of a middle dielectric substrate shown in FIG. 9.
Figure 13:
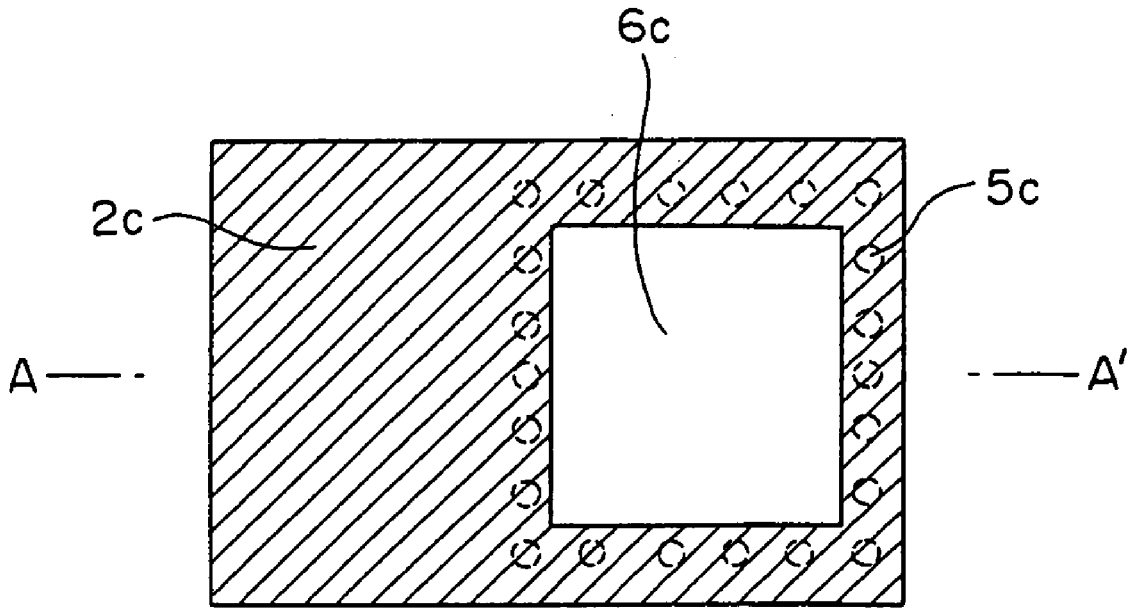
FIG. 13 is a view showing a conductor pattern arranged on a lower side surface of a lower dielectric substrate shown in FIG. 9.

FIG. 9 is a cross sectional view showing a construction of the waveguide-to-microstrip transition according to Embodiment 3 of the present invention. Also, FIG. 10 is a view showing a conductor pattern arranged on an upper side surface of an upper dielectric substrate shown in FIG. 9. FIG. 11 is a view showing a conductor pattern arranged on a lower side surface of the upper dielectric substrate shown in FIG. 9. Moreover, FIG. 12 is a view showing a conductor pattern arranged on a lower side surface of a middle dielectric substrate shown in FIG. 9. FIG. 13 is a view showing a conductor pattern arranged on a lower side surface of a lower dielectric substrate shown in FIG. 9. Note that, the cross sectional view shown in FIG. 9 is given in the form of a cross sectional view taken along a line A–A' of FIGS. 10 to 13.

In FIGS. 9 to 13, ground conductor patterns 2*a*, 2*b*, and 2*c* are arranged on lower sides of dielectric substrates 1*a*, 1*b*, and 1*c*, respectively. A strip conductor pattern 3 and a conductor pattern 4 for shorting of a waveguide are arranged on an upper side of the dielectric substrate 1*a*. Vias 5*a*, 5*b*, and 5*c* for a waveguide wall are provided in the dielectric substrates 1*a*, 1*b* and, 1*c*. In addition, the ground conductor patterns 2*a*, 2*b* and, 2*c* are provided with ground conductor patterns opening portions 6*a*, 6*b* and, 6*c*, respectively.

The strip conductor pattern 3 is provided on the upper side surface of the dielectric substrate 1*a*, and the ground conductor pattern 2*a* is provided in the lower side surface of the dielectric substrate 1*a* to thereby construct a "microstrip line". In addition, the conductor pattern 4 for shorting of a waveguide is provided in the upper side surface of the dielectric substrate 1*a*, the ground conductor pattern 2*a* is provided on the lower side surface of the dielectric substrate 1*a*, and the vias 5*a* for a waveguide wall for connecting the conductor pattern 4 for shorting of a waveguide and the ground conductor pattern 2*a* to each other are provided to thereby construct a "waveguide shorting portion". Moreover, the ground conductor pattern 2*b* is provided on the lower side surface of the dielectric substrate 1*b*, and the vias 5*b* for a waveguide wall for connecting the ground conductor patterns 2*a* and 2*b* to each other are provided to thereby construct a "dielectric waveguide" (first dielectric waveguide). Moreover, the ground conductor pattern 2*c* is provided on the lower side surface of the dielectric substrate 1*c*, and the vias 5*c* for a waveguide wall for connecting the ground conductor patterns 2*b* and 2*c* to each other are provided to thereby construct a "dielectric waveguide" (second dielectric waveguide). The waveguide 7 (FIG. 9) is provided under the dielectric substrate 1*c* so as to correspond to an opening of the dielectric waveguide.

Next, an operation of the waveguide-to-microstrip transition according to Embodiment 3 will herein below be described with reference to the drawings.

In the waveguide-to-microstrip transition having the construction as described above, a high frequency signal inputted to the microstrip line provided on the dielectric substrate 1*a* is propagated through the dielectric waveguide formed using the dielectric substrate 1*b* via the waveguide shorting portion. Moreover, the high frequency signal passes through the dielectric waveguide formed using the dielectric substrate 1*c* to be propagated through the waveguide 7 via the ground conductor pattern omission portion 6*c*.

As described above, according to Embodiment 3, similarly to Embodiment 1, the shorting waveguide block projecting from the dielectric substrate by about ¼ of the guide wavelength as in the above-mentioned prior art example is removed and the highly accurate assembly is not required. Hence, it is possible to realize the miniature waveguide-to-microstrip transition which is easy in mass production.

In addition, the waveguide-to-microstrip transition is constituted by only the conductor patterns and the vias of the substrate. Thus, there is also offered an effect that the waveguide-to-microstrip transition can be formed inside the dielectric substrate, and can also be incorporated easily in a package formed using ceramics and the like.

Moreover, since a plurality of dielectric waveguides formed using the ground conductor patterns and the vias for a waveguide wall within the dielectric substrates are operated as a multisection impedance transformer, it becomes possible to obtain the impedance matching over a broad band.

Embodiment 4

A waveguide-to-microstrip transition according to Embodiment 4 of the present invention will herein below be described with reference to the drawings.

Figure 14:
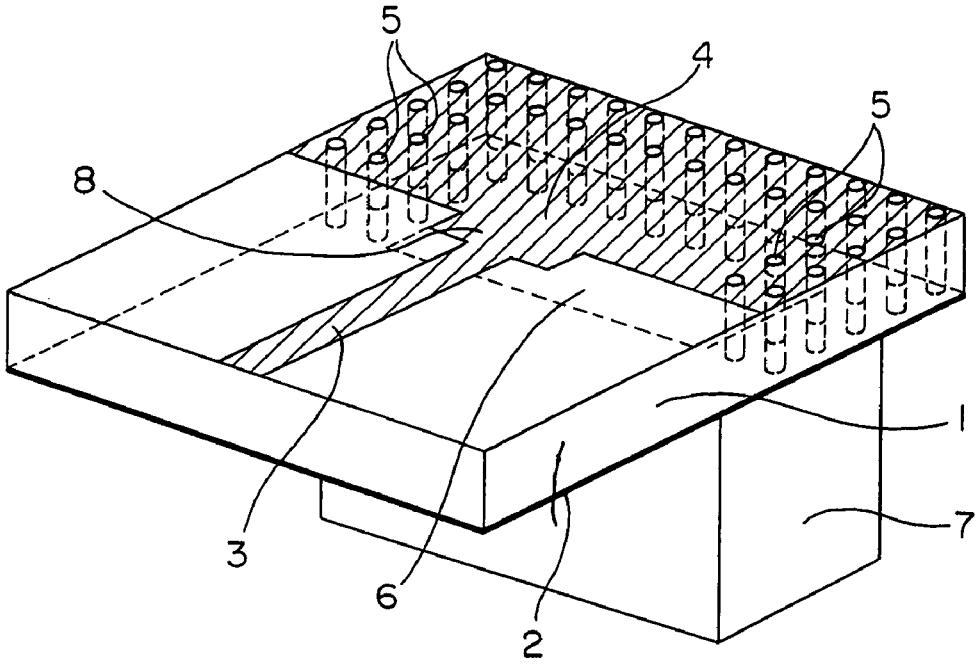
FIG. 14 is a perspective view showing a construction of a waveguide-to-microstrip transition according to Embodiment 4 of the present invention.

FIG. 14 is a perspective view showing a waveguide-to-microstrip transition according to Embodiment 4 of the present invention. In FIG. 14, a strip conductor pattern width extension portion 8 is provided between a strip conductor pattern 3 and a conductor pattern 4 for shorting of a waveguide.

In the waveguide-to-microstrip transition having the construction as described above, since the strip conductor pattern width extension portion 8 is provided to thereby allow a shunt capacitance to be added, it is possible to carry out impedance matching for a transition having inductance. In addition, in the strip conductor pattern width extension portion 8, a distribution of the electric field in the microstrip line is concentrated on a dielectric substrate side. Hence, it is possible to suppress the radiation to a space extending above a connection portion between the strip conductor pattern 3 and the conductor pattern 4 for shorting of a waveguide.

As described above, according to Embodiment 4, similarly to Embodiment 1, the shorting waveguide block projecting from the dielectric substrate by about ¼ of the guide wavelength as in the above-mentioned prior art example is removed and the highly accurate assembly is not required. Hence, it is possible to realize the miniature waveguide-to-microstrip transition which is easy in mass production.

In addition, the waveguide-to-microstrip transition is constituted by only the conductor patterns and the vias of the substrate. Thus, there is also offered an effect that the waveguide-to-microstrip transition can be formed inside the dielectric substrate, and can also be incorporated easily in a package formed using ceramics and the like.

Moreover, since the waveguide-to-microstrip transition has the strip conductor pattern width extension portion 8, the waveguide-to-microstrip transition can be realized in which the unnecessary radiation from the transition to the space is suppressed.

Embodiment 5

Next, a waveguide-to-microstrip transition according to Embodiment 5 of the present invention will hereinbelow be described with reference to the drawings.

Figure 15:
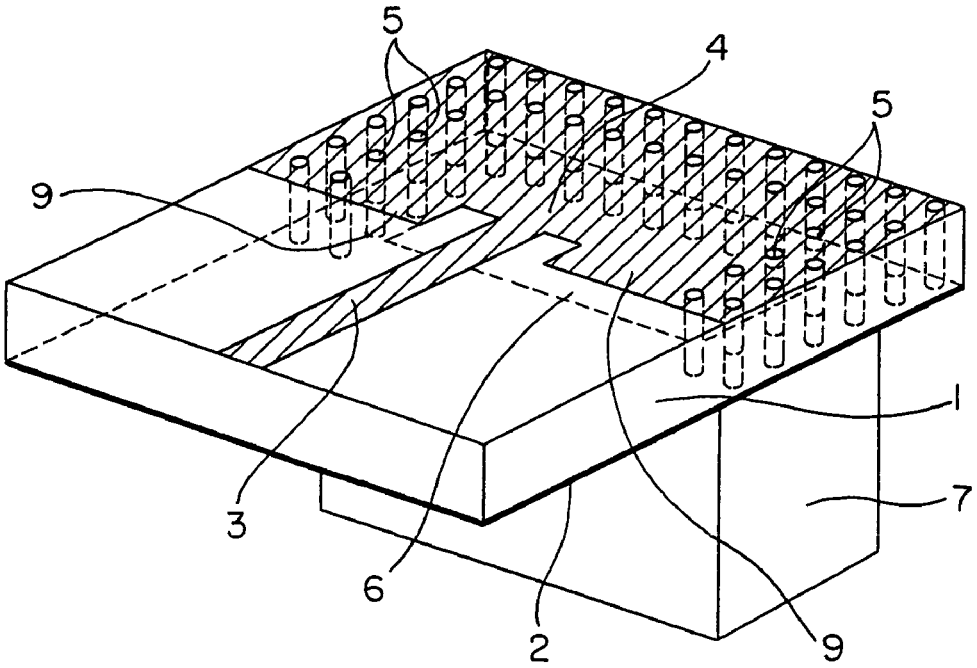
FIG. 15 is a perspective view showing a construction of a waveguide-to-microstrip transition according to Embodiment 5 of the present invention.

FIG. 15 is a perspective view showing a waveguide-to-microstrip transition according to Embodiment 5 of the present invention. In FIG. 15, conductor pattern overhang portions 9 for shorting of a waveguide are provided on the both sides of a connection portion between a strip conductor pattern 3 and a conductor pattern 4 for shorting of a waveguide while being apart from the strip conductor pattern 3.

In the waveguide-to-microstrip transition having the construction as described above, even when the connection portion between the strip conductor pattern 3 and the conductor pattern 4 for shorting of a waveguide is located above a ground conductor pattern omission portion 6, almost a portion located above the ground conductor pattern omission portion 6 can be covered with the conductor pattern. Hence, the radiation to the space extending above the connection portion can be suppressed.

As described above, according to Embodiment 5, similarly to Embodiment 1, the shorting waveguide block projecting from the dielectric substrate by about ¼ of the guide wavelength as in the above-mentioned prior art example is removed and the highly accurate assembly is not required. Hence, it is possible to realize the miniature waveguide-to-microstrip transition which is easy in mass production.

In addition, the waveguide-to-microstrip transition is constituted by only the conductor patterns and the vias of the substrate. Thus, there is also offered an effect that the waveguide-to-microstrip transition can be formed inside the dielectric substrate, and can also be incorporated easily in a package formed using ceramics and the like.

Moreover, since the waveguide-to-microstrip transition has the conductor pattern overhang portions 9 for shorting of a waveguide, there is also offered an effect that the unnecessary radiation from the transition to the space can be suppressed.

INDUSTRIAL APPLICABILITY

According to the present invention, as described above, since the shorting waveguide block projecting from the dielectric substrate by about ¼ of a guide wavelength as in the prior art example is removed, and hence highly accurate assembly is not also required, the miniature waveguide-to-microstrip transition is obtained which is easy in mass production.

In addition, since the waveguide-to-microstrip transition is constituted by only the conductor patterns and the vias of the substrate, the waveguide-to-microstrip transition can be formed inside the dielectric substrate, and can also be incorporated easily in a package formed using ceramics and the like.

The invention claimed is:

1. A waveguide-to-microstrip transition, comprising:

a first dielectric substrate;

a first ground conductor pattern which is disposed on one surface of the first dielectric substrate and which has a first ground conductor pattern omission portion;

a strip conductor pattern disposed on a surface of the first dielectric substrate opposite to the surface having the first ground conductor pattern; a conductor pattern for shorting of a waveguide disposed so as to be continuously connected to the strip conductor pattern; and first connecting conductors for connecting the first ground conductor pattern and the conductor pattern for shorting of a waveguide to each other within the first dielectric substrate;

a second dielectric substrate;

a second ground conductor pattern which is disposed on one surface of the second dielectric substrate and which has a second ground conductor pattern omission portion; and second connecting conductors provided in a periphery of the second ground conductor pattern omission portion so as to vertically extend through the second dielectric substrate; and a third dielectric substrate;

a third ground conductor pattern which is disposed on one surface of the third dielectric substrate and which has a third ground conductor pattern omission portion;

third connecting conductors provided in a periphery of the third ground conductor pattern omission portion so as to vertically extend through the third dielectric substrate; and a waveguide connected to the third dielectric substrate so as to correspond to the third ground conductor pattern omission portion, wherein the first dielectric substrate and the second dielectric substrate are laminated so that the first ground conductor pattern faces a surface of the second dielectric substrate opposite to the surface having the second ground conductor pattern, the second dielectric substrate and the third dielectric substrate are laminated so that the second ground conductor pattern faces a surface of the third dielectric substrate opposite to the surface having the third ground conductor pattern, a microstrip line is constituted by the strip conductor pattern, the first ground conductor pattern, and the first dielectric substrate, a waveguide shorting portion is constituted by the conductor pattern for shorting of a waveguide, the first ground conductor pattern, and the first connecting conductors, a first dielectric waveguide is constituted by the first ground conductor pattern, the second ground conductor pattern, and the second connecting conductors, and a second dielectric waveguide is constituted by the second ground conductor pattern, the third ground conductor pattern, and the third connecting conductors.

2. A waveguide-to-microstrip transition according to claim 1, wherein an area surrounded by the second connecting conductors within the second dielectric substrate is different in size from an area surrounded by the third connecting conductors within the third dielectric substrate.

3. A waveguide-to-microstrip transition according to claim 1, wherein each of the first, second, and third ground conductor pattern omission portion is a polygon, and a position of a boundary between the strip conductor pattern and the conductor pattern for shorting of a waveguide agrees with one side of the polygon, or is located inside the polygon.

4. A waveguide-to-microstrip transition according to claim 1, wherein each of the first, second and third connecting conductors are constituted by a plurality of vias.

5. A waveguide-to-microstrip transition according to claim 1, wherein a strip conductor pattern width extension portion is inserted between the strip conductor pattern and the conductor pattern for shorting of a waveguide.

6. A waveguide-to-microstrip transition according to claim 1, wherein a cutout portion is provided in the conductor pattern for shorting of a waveguide.

7. A waveguide-to-microstrip transition, comprising:

a first dielectric substrate;

a first ground conductor pattern which is disposed on one surface of the first dielectric substrate and which has a first ground conductor pattern omission portion;

a strip conductor pattern disposed on a surface of the first dielectric substrate opposite to the surface having the first ground conductor pattern; a conductor pattern for shorting of a waveguide disposed so as to be continuously connected to the strip conductor pattern;

first connecting conductors for connecting the first ground conductor pattern and the conductor pattern for shorting of a waveguide to each other within the first dielectric substrate;

a second dielectric substrate;

a second ground conductor pattern which is disposed on one surface of the second dielectric substrate and which has a second ground conductor pattern omission portion;

second connecting conductors provided in a periphery of the second ground conductor pattern omission portion so as to vertically extend through the second dielectric substrate; and a waveguide connected to the second dielectric substrate so as to correspond to the second ground conductor pattern omission portion, wherein:

the first dielectric substrate and the second dielectric substrate are laminated so that the first ground conductor pattern faces a surface of the second dielectric substrate opposite to the surface having the second ground conductor pattern;

a microstrip line is constituted by the strip conductor pattern, the first ground conductor pattern, and the first dielectric substrate;

a waveguide shorting portion is constituted by the conductor pattern for shorting of a waveguide, the first ground conductor pattern, and the first connecting conductors;

a dielectric waveguide is constituted by the first ground conductor pattern, the second ground conductor pattern, and the second connecting conductors; and a strip conductor pattern width extension portion is inserted between the strip conductor pattern and the conductor pattern for shorting of a waveguide.

8. A waveguide-to-microstrip transition, comprising:

a dielectric substrate;

a ground conductor pattern which is disposed on one surface of the dielectric substrate and which has a ground conductor pattern omission portion;

a strip conductor pattern disposed on a surface of the dielectric substrate opposite to the surface having the ground conductor pattern;

a conductor pattern for shorting of a waveguide disposed so as to be continuously connected to the strip conductor pattern;

connecting conductors for connecting the ground conductor pattern and the conductor pattern for shorting of a waveguide to each other within the dielectric substrate; and a waveguide connected to the dielectric substrate so as to correspond to the ground conductor pattern omission portion, wherein:

a microstrip line is constituted by the strip conductor pattern, the ground conductor pattern, and the dielectric substrate;

a dielectric waveguide shorting portion is constituted by the conductor pattern for shorting of a waveguide, the ground conductor pattern, and the connecting conductors; and a strip conductor pattern width extension portion is inserted between the strip conductor pattern and the conductor pattern for shorting of a waveguide.

* * * * *